US008564495B2

(12) United States Patent
Leem

(10) Patent No.: US 8,564,495 B2
(45) Date of Patent: Oct. 22, 2013

(54) PORTABLE TERMINAL

(75) Inventor: Jihun Leem, Bucheon (KR)

(73) Assignee: LG Electronics Inc., Seoul (KR)

( * ) Notice: Subject to any disclaimer, the term of this patent is extended or adjusted under 35 U.S.C. 154(b) by 421 days.

(21) Appl. No.: 12/910,649

(22) Filed: Oct. 22, 2010

(65) Prior Publication Data

US 2011/0102289 A1 May 5, 2011

(30) Foreign Application Priority Data

Nov. 5, 2009 (KR) ..... 10-2009-0106605
Mar. 11, 2010 (KR) ..... 10-2010-0021901

(51) Int. Cl.
*H01Q 1/48* (2006.01)
*H01Q 1/24* (2006.01)

(52) U.S. Cl.
USPC ..... 343/846; 343/702

(58) Field of Classification Search
USPC ..... 343/702, 700 MS, 846
See application file for complete search history.

(56) References Cited

U.S. PATENT DOCUMENTS 5,831,577 A 11/1998 Nichols et al.
5,973,648 A 10/1999 Lindenmeier et al.
7,046,201 B2 * 5/2006 Okada ..... 343/700 MS
7,705,787 B2 * 4/2010 Ponce De Leon et al. .... 343/702
2008/0079642 A1 * 4/2008 Ishizuka et al. ..... 343/702
2009/0121948 A1 * 5/2009 Nysen ..... 343/702
2011/0074641 A1 * 3/2011 Sotoma et al. ..... 343/702

FOREIGN PATENT DOCUMENTS

EP 0837521 A2 4/1998
EP 0847103 A2 6/1998
WO 01/20716 A1 3/2001
WO 02/078123 A1 10/2002

* cited by examiner

*Primary Examiner* — Hoanganh Le
(74) *Attorney, Agent, or Firm* — Birch, Stewart, Kolasch & Birch, LLP

(57) ABSTRACT

A portable terminal is discussed. An embodiment of the portable terminal includes a portable terminal comprising a terminal body and a hybrid antenna mounted in the terminal body and having a plurality of antennas of different shapes wherein the hybrid antenna includes a first antenna having one or more dielectric chips, a third radiation patch formed on a first surface of the dielectric chip configured to operate at a first band, a feed pad formed on a second surface of the dielectric chip and the feed pad configured to feed the third radiation patch, and one or more ground pads arranged on the second surface of the dielectric chip located at a predetermined distance from the feed pad and a second antenna connected to the feed pad, and configured to operate at a second band higher than the first band.

23 Claims, 9 Drawing Sheets

PORTABLE TERMINAL

BACKGROUND OF THE INVENTION

1. Field of the Invention

The present invention relates to a portable terminal, and particularly, to an antenna device for a portable terminal.

2. Background of the Invention

A portable terminal is a device that can be carried around and has one or more functions such as voice and video call communication, inputting and outputting information, storing data, and the like.

As such functions become more diversified, the portable terminal can support more complicated functions such as capturing images or video, reproducing music or video files, playing games, receiving broadcast signals, and the like. By comprehensively and collectively implementing such functions, the portable terminal may be embodied in the form of a multimedia player or device.

In order to implement various functions of such multimedia players or devices, the multimedia player requires sufficient support in terms of hardware or software, for which numerous attempts are being made and implemented. For example, a user interface allowing users to easily and conveniently search for and select one or more functions is provided.

As information communications technique develops, a portable terminal is being developed for transmission of a large amount of data based on a packet transmission, rather than for circuit switching. In the 3GPP2, research to develop an LTE system is ongoing. In a portable terminal market, required are a portable terminal having LTE&CDMA and CDMA_AWS band, a portable terminal provided with diversity, etc. More concretely, in the LTE system, an antenna for MIMO is required, a larger form factor for CDMA_AWS band cover is required, or an Rx diversity antenna for CDMA EVDO_A is required.

SUMMARY OF THE INVENTION

Therefore, an object of the present invention is to provide an antenna device capable of minimizing mutual coupling between antennas installed at a limited space, and capable of easily implementing diversity.

Another object of the present invention is to provide an antenna device capable of minimizing increase of costs or lowering of a performance due to miniaturization of an antenna.

To achieve these and other advantages and in accordance with the purpose of the present invention, as embodied and broadly described herein, there is provided a portable terminal, comprising: a terminal body; and a hybrid antenna mounted in the terminal body and having a plurality of antennas of different shapes, wherein the hybrid antenna includes a first antenna having one or more dielectric chips, a radiation patch formed on a first surface of the dielectric chip so as to operate at a first band, a feed pad formed on a second surface of the dielectric chip and configured to feed the radiation patch, and one or more ground pads formed at the feed pad with a distance therebetween; and a second antenna connected to the feed pad, and formed to operate at a second band higher than the first band.

According to one embodiment, the portable terminal may further comprise a ground extension portion extending from one side of the ground pad.

According to another embodiment, the ground extension portion may be bent by a predetermined angle with respect to the ground pad.

According to another embodiment, the ground pads may be formed at both sides of the feed pad, and the ground extension portions may be extending from the ground pads and implementing one surface.

According to another embodiment, the second antenna may be connected to the feed pad thus to be fed with the first antenna by one feed path.

According to another embodiment, the ground pad and the feed pad may be arranged with an adjustable distance therebetween.

According to another embodiment, the dielectric chip may include a second dielectric layer having a third radiation patch on an upper surface thereof and having a second radiation patch on a lower surface thereof, and having a first dielectric layer deposited below the second dielectric layer, and having a first radiation patch on an upper surface thereof; and having an air gap layer disposed between the first and second dielectric layers.

According to another embodiment, the second radiation patch may form ground of the first radiation patch.

According to another embodiment, the second radiation patch may be floated with respect to ground of a circuit board.

According to another embodiment, the second radiation patch may be connected to the ground of the circuit board.

According to another embodiment, the air gap layer may be configured to maintain a constant gap by at least two spacers.

According to another embodiment, the first radiation patch and the third radiation patch may be connected to each other by a conductive pin which penetrates the second antenna in a vertical direction, and may be converged to the feed pad.

According to another embodiment, the first radiation patch may have a pattern to radiate or receive wireless signals of a high band, whereas the third radiation patch may have a pattern to radiate or receive wireless signals of a low band.

According to another embodiment, the second antenna may be implemented as a flexible printed circuit board (FPCB).

According to another embodiment, the feed path may be implemented as a coaxial cable or an FPCB.

According to another embodiment, the portable terminal may further comprise a supporting body formed in correspondence to an internal shape of the portable terminal, and configured to support the first and second antennas.

To achieve these and other advantages and in accordance with the purpose of the present invention, as embodied and broadly described herein, there is provided a portable terminal, comprising: a main antenna disposed at a first position of a terminal body; and a hybrid antenna disposed at a second position of the terminal body spacing from the first position, and configured to implement diversity of the main antenna, wherein the hybrid antenna includes a first antenna having one or more dielectric chips, a first radiation patch formed on a first surface of the dielectric chip so as to operate at a first band, a feed pad formed on a second surface of the dielectric chip and configured to feed the first radiation patch, and one or more ground pads formed at the feed pad with a distance therebetween; and a second antenna connected to the feed pad, and formed to operate at a second band higher than the first band.

According to another embodiment, the portable terminal further comprises a ground extension portion extending from one side of the ground pad.

According to another embodiment, the ground pad and the ground extension portion may be configured to be separated from ground of the main antenna.

According to another embodiment, the ground pads may be formed at both sides of the feed pad, and the ground extension portions may be extending from the ground pads and implementing one surface.

According to another embodiment, the ground extension portion may be bent by a predetermined angle with respect to the ground pad.

According to another embodiment, the first and second antennas may be arranged such that extended surfaces thereof are perpendicular to each other above the circuit board.

According to another embodiment, the dielectric chip may include a second dielectric layer having a third radiation patch on an upper surface thereof and having a second radiation patch on a lower surface thereof, and having a first dielectric layer deposited below the second dielectric layer, and having a first radiation patch on an upper surface thereof; and having an air gap layer disposed between the first and second dielectric layers.

According to another embodiment, the first radiation patch may have a pattern to radiate or receive wireless signals of a high band, whereas the third radiation patch may have a pattern to radiate or receive wireless signals of a low band.

To achieve these and other advantages and in accordance with the purpose of the present invention, as embodied and broadly described herein, there is provided a portable terminal including a terminal body, and a hybrid antenna mounted in the terminal body and having a plurality of antennas of different shapes, wherein the hybrid antenna includes a first antenna having one or more dielectric chips, a third radiation patch formed on a first surface of the dielectric chip configured to operate at a first band, a feed pad formed on a second surface of the dielectric chip and the feed pad configured to feed the third radiation patch, and one or more ground pads arranged on the second surface of the dielectric chip located at a predetermined distance from the feed pad, and a second antenna connected to the feed pad, and configured to operate at a second band higher than the first band.

To achieve these and other advantages and in accordance with the purpose of the present invention, as embodied and broadly described herein, there is provided a portable terminal including a main antenna disposed at a first position of a terminal body, at least one hybrid antenna disposed at a second position of the terminal body at a predetermined distance from the first position, and configured to implement diverse band widths of the main antenna, wherein the at least one hybrid antenna includes a first antenna having one or more dielectric chips, a third radiation patch formed on a first surface of the dielectric chip configured to operate at a first band, a feed pad formed on a second surface of the dielectric chip and the feed pad configured to feed the third radiation patch, and one or more ground pads arranged on the second surface of the dielectric chip located at a predetermined distance from the feed pad; and a second antenna connected to the feed pad, and configured to operate at a second band higher than the first band; and a conductive pin configured to penetrate the second radiation patch in a vertical direction, the conductive pin connecting a first radiation patch and the third radiation patch, wherein the first radiation patch and the third radiation patch are connected to the feed pad.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

For the sake of brief description with reference to the drawings, the same or equivalent components will be provided with the same reference numbers, and description thereof will not be repeated.

Figure 1:
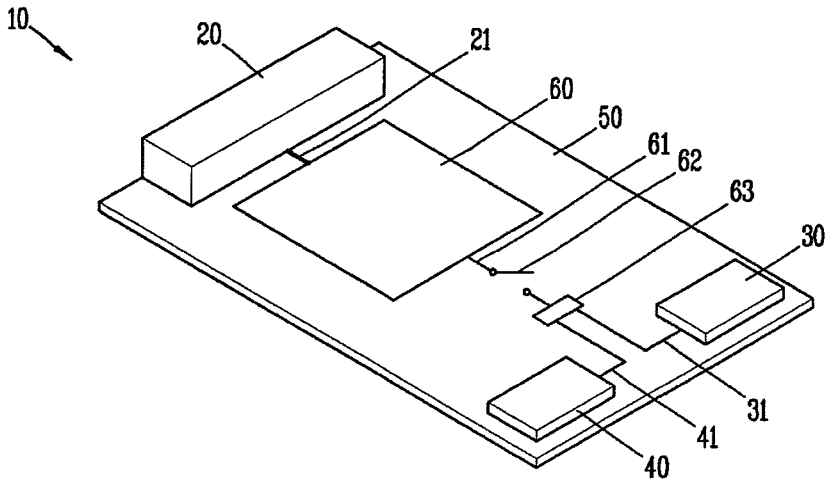
FIG. 1 is a conceptual view showing one example of an antenna system for a portable terminal according to the present invention.

FIG. 1 is a conceptual view showing one example of an antenna system for a portable terminal according to the present invention.

The antenna system 10 includes a plurality of antennas. These antennas include a main antenna 20 configured to operate in one or more mobile communications bands, a first antenna 30 configured to implement diversity of the main antenna 20, and a second antenna 40 configured to operate in a relatively high band.

The main antenna 20 is configured to be fed to an RF processor 60 provided at a circuit board 50 by a first feed path 21. The first antenna 30 and the second antenna 40 are spaced from the first antenna 20 by a constant distance so as to implement diversity of the main antenna 20.

The first antenna 30 is configured to cover a relatively low band (e.g., about 700~800 MHz), whereas the second antenna 40 is configured to cover a relatively high band (e.g., about 1900~2600 MHz).

A first feed portion 31 suitable for the first antenna 30 is connected to the first antenna 30, and a second feed portion 41 suitable for the second antenna 40 is connected to the second antenna 40. These first and second feed portions 31 and 41 meet at a point by a means for easily identifying signals from the first and second antennas 30 and 40 which cover different bands, e.g., a diplexer 63 or a switch, and are connected to a second feed path 61. A mobile switch 62 configured to selectively connect the antennas 30 and 40 to the RF processor 60 is provided between the second feed path 61 and the diplexer 63. Characteristics of the first and second antennas 30 and 40 will be explained in more detail with reference to FIG. 2.

Figure 2:
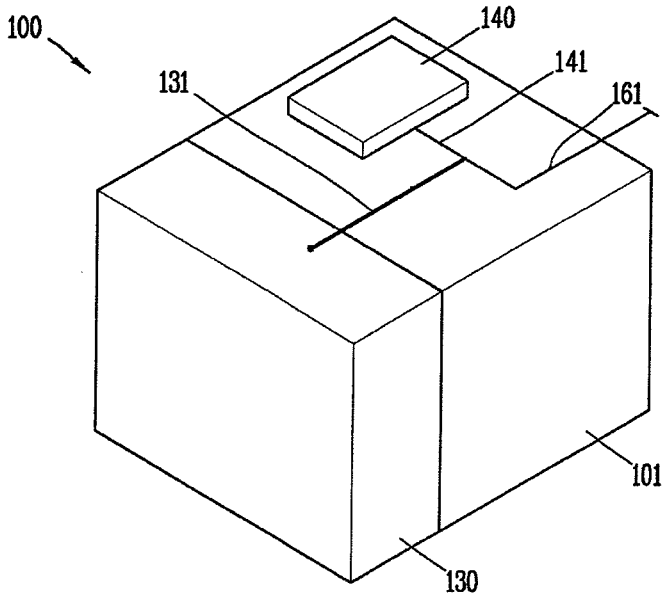
FIG. 2 is a conceptual view of a hybrid antenna according to one example of the present invention.

FIG. 2 is a conceptual view of a hybrid antenna 100 according to the present invention.

As shown in FIG. 2, the first antenna 130 and the second antenna 140 constitute one body modularized by a supporting body 101.

The first antenna 130 covers a low band (e.g., 500 MHz, LTE band 12, LTE band 13, LTE band 17, 850 MHz, 900 MHz, etc.), and may be configured in the form of a patch so as to operate in a wideband.

The second antenna 140 covers a high band (e.g., LTE band 4, LTE band 7, 1900 MHz, WCDMA 2100 MHz, etc.), and may be configured in the form of a chip, a PCB, or a press type (conductive metallic plate mounted, in a pressing manner, on a plastic carrier having a predetermined shape).

A first feed portion 131 for feeding the first antenna 130 and a second feed portion 141 for feeding the second antenna 140 are converged to one feed path 161, and are fed to a circuit board for RF processing, etc.

This antenna system is a smart antenna system for implementing a Multi Input Multi Out (MIMO) technique, and may be considered as a type of 'hybrid antenna' in that the first and second antennas cover different bands and have different forms. The supporting body 101 may have a shape or a structure (e.g., hooks, screw assembly recesses) for supporting or fixing the first antenna 130 and the second antenna 140, or a modification example thereof. The supporting body 101 may have a shape suitable for internal circumstances of a wireless modem device.

Figure 3:
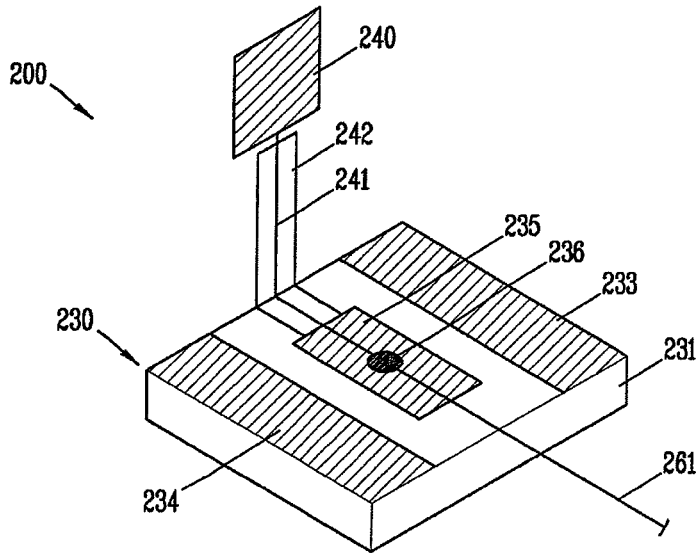
FIG. 3 is a perspective view of the hybrid antenna according to the present invention, which is viewed from one direction.
Figure 4:
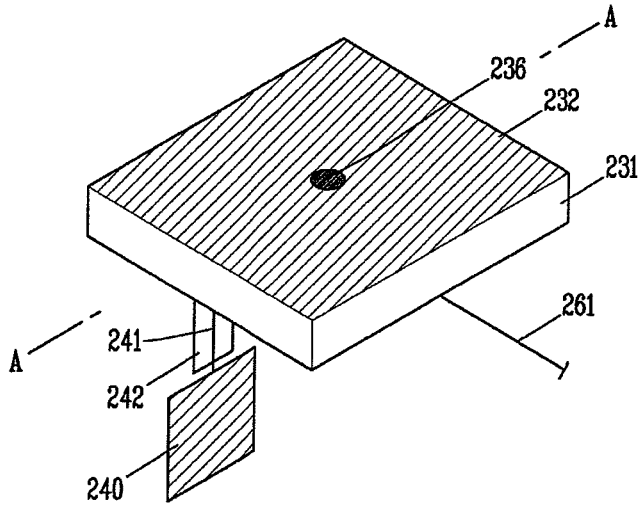
FIG. 4 is a perspective view of the hybrid antenna according to the present invention, which is viewed from the opposite direction.

FIG. 3 is a perspective view of the hybrid antenna according to the present invention, which is viewed from one direction. And, FIG. 4 is a perspective view of the hybrid antenna according to the present invention, which is viewed from the opposite direction.

As shown, a first antenna 230 of the hybrid antenna 200 is implemented in the form of a patch, and a feed line 241 of the second antenna 240 is connected to a feed pad 235 of the dielectric chip 231. The feed line 241 is separately formed from the first antenna 230.

The first antenna 230 includes a radiation patch 232 so as to easily implement a wideband at a low band (e.g., 500 MHz, LTE band 12, LTE band 13, LTE band 17, 850 MHz, 900 MHz, etc.). The radiation patch 232 may be formed on an upper surface of the dielectric chip 231, and may have a specific pattern so as to control a resonance length.

For miniaturization of the antenna, the dielectric chip 231 may have a high dielectric constant (e.g., 10~80) which corresponds to a several tens of dielectric constant or more than. The dielectric chip 231 may be implemented by laminating a plurality of dielectric layers having different dielectric constants or the same dielectric constant. Alternatively, the radiation patch may be provided between the dielectric layers. In this case, the dielectric layers may be formed to have an air gap therebetween.

Ground pads 233 and 234, and a feed pad 235 are formed on a lower surface of the dielectric chip 231. The ground pads 233 and 234 may be formed so that a first antenna 230 can be stably mounted on a substrate, and an area large enough to resonate the radiation patch 232 can be obtained. For this, as shown in FIG. 3, the ground pads 233 and 234 are separately formed on two parts of the lower surface of the dielectric chip 231.

The feed pad 235 is disposed between the two ground pads 233 and 234, and the feed pad 235 and the radiation patch 232 are connected to each other by a through pin 236.

This first antenna 230 is suitable for covering a low band and obtaining a wideband.

Differently from the first antenna 230 implemented in the form of a patch, the second antenna 240 may be implemented in the form of a monopole antenna. In a structural aspect, the second antenna 240 may be implemented in the form of a printed circuit board (PCB), a press type, or a flexible printed circuit board (FPCB). The second antenna 240 is electrically connected to the feed pad 235 of the first antenna 230 by the feed line 241. The feed line 241 may be supported by an insulation film 242, and the insulation film 242 may include a ground metal. This second antenna 240 covers a high band, and has performance improvement, by at least 4 dB, than the first antenna 230 implemented in the patch type. Furthermore, the second antenna 240 has a thin thickness, and can be easily controlled in correspondence to an internal shape of a portable terminal or a wireless modem device. This may allow the conventional antenna size to be significantly reduced. Referring to the following table 1, average gains at a low band (about 750 MHz based on a central frequency) and a high band (about 1900 MHz based on a central frequency) are within −3 dB. This means that the gains are not lowered at both the low band and the high band.

TABLE 1

| Freq. [GHz] | Avg. [dBi] |
|---|---|
| 0.746 | −2.58 |
| 0.75 | −2.88 |
| 0.756 | −2.85 |
| 0.777 | −3.08 |
| 0.782 | −2.71 |
| 0.787 | −2.87 |
| 0.824 | −4.63 |
| 0.849 | −5.42 |
| 0.869 | −4.81 |
| 0.88 | −4.7 |
| 0.894 | −5.16 |
| 1.57 | −17.25 |
| 1.575 | −18.02 |
| 1.58 | −17.35 |
| 1.85 | −8.01 |
| 1.89 | −4.68 |
| 1.91 | −3.2 |
| 1.93 | −1.29 |
| 1.96 | −0.33 |
| 1.99 | −1.55 |

The first antenna 230 and the second antenna 240 are connected to each other at the feed pad 235 of the first antenna 230, and are fed by one feed line 261. More concretely, the first antenna 230 implemented in the form of a patch and providing a wideband, and the second antenna 240 having an improved wireless characteristic of a high band are connected to each other by one feed line, an RF circuitry (preferably, a coaxial cable or an RF FPCB). Detailed configurations of the dielectric chip will be explained with reference to FIGS. 7 to 11.

Figure 5:
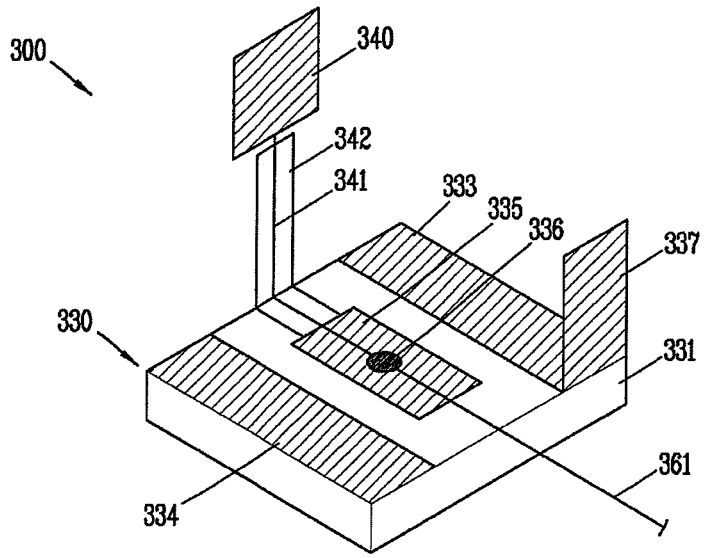
FIG. 5 is a perspective view of a hybrid antenna according to another example of the present invention.
Figure 6:
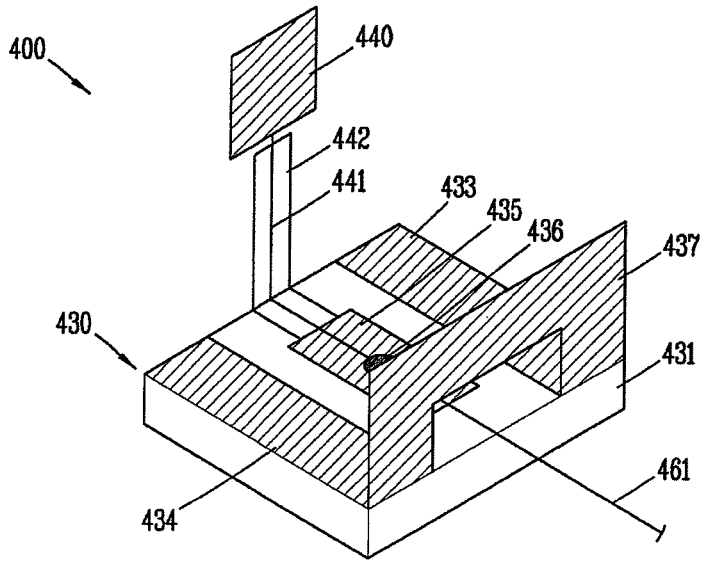
FIG. 6 is a perspective view of a hybrid antenna according to still another example of the present invention.

FIG. 5 is a perspective view of a hybrid antenna 300 according to another example of the present invention, and FIG. 6 is a perspective view of a hybrid antenna 400 according to still another example of the present invention.

As shown, ground pads 333, 433 and 434 of first antennas 330 and 430 may be extending to a specific direction so as to obtain a wide ground area. More concretely, FIG. 5 shows a ground extension portion 337 extending from the pad 333 of the ground pads 333 and 334, and FIG. 6 shows a ground extension portion 437 extending from the ground pads 433 and 434 and implementing one surface. This ground extension portion 437 may have a shape suitable for internal circumstances of an electronic device such as a portable terminal.

A ground extended by the ground extension portion 437 may widen a bandwidth of the first antenna 430. Furthermore, the ground extension portion 437 formed of a conductive metallic material having strength may constitute a part of a mechanical component of the portable terminal. Other components, i.e., feed pads 335 and 435, through pins 336 and 436, and feed paths 361 and 461 have similar configurations to the corresponding components of FIG. 3, and thus detailed explanations thereof will be omitted.

Figure 7:
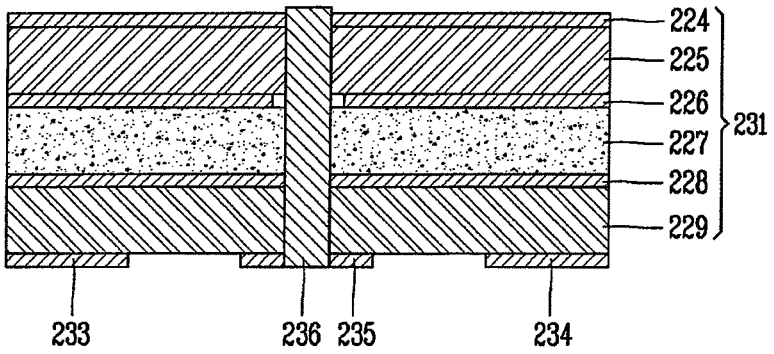
FIG. 7 is a sectional view taken along line 'A-A' in FIG. 4.
Figure 8:
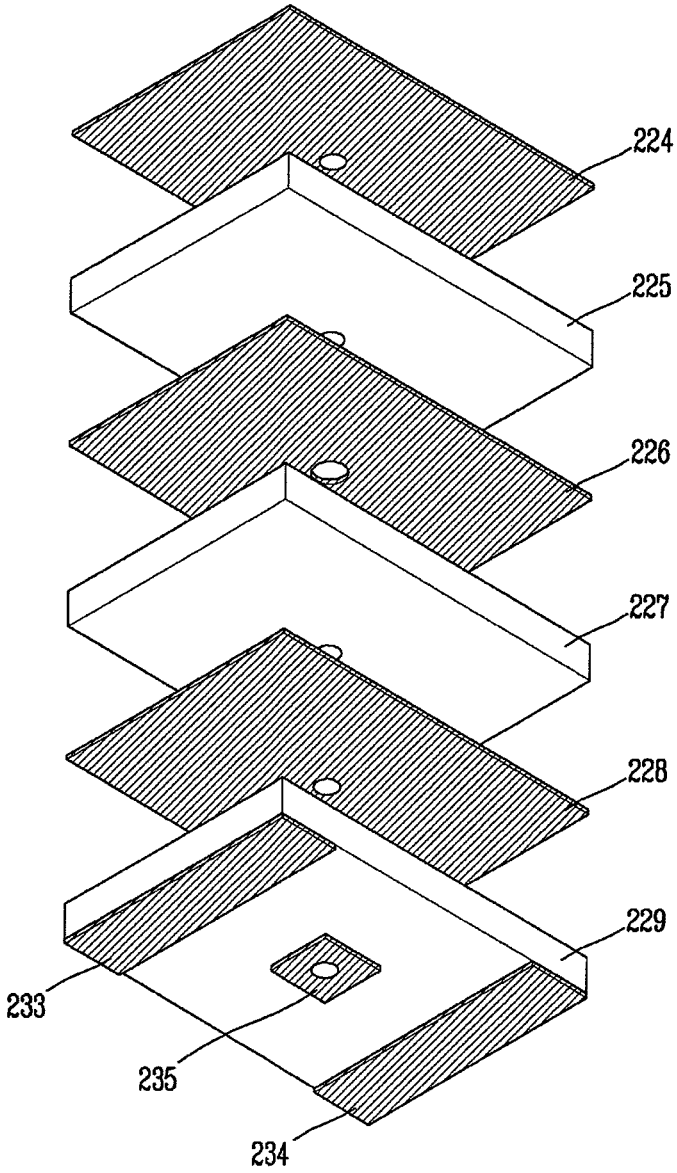
FIG. 8 is a disassembled perspective view of the hybrid antenna of FIG. 7, which is viewed from a bottom surface.

FIG. 7 is a sectional view taken along line 'A-A' in FIG. 4. And, FIG. 8 is a disassembled perspective view of the hybrid antenna of FIG. 7, which is viewed from a bottom surface.

The dielectric chip 231 may be attached to a circuit board having an independent ground.

The dielectric chip 231 is formed as a plurality of radiation patches 228, 226 and 224 are laminated on each other. More concretely, the dielectric chip 231 may include a first dielectric layer 229, first radiation patch 228, an air gap layer 227, a second radiation patch 226 and a third radiation patch 224.

The first radiation patch 228 and the third radiation patch 224 serve to radiate or receive wireless signals of different bands, and may include various patterns for obtaining lengths and wireless characteristics suitable for the bands. However, the various patterns are omitted in the drawings.

The first radiation patch 228 may be configured to cover a low band, whereas the second radiation patch 226 may be configured to cover a high band. For instance, the first radiation patch 228 may cover a band of about 700 MHz, and the second radiation patch 226 may cover a GPS band. Combined bands between a low band and a high band may include 700 MHz/800 MHz, 700 MHz/900 MHz, 700 MHz/1900 MHz, 700 MHz/2100 MHz, 800 MHz/1900 MHz, etc. With the radiation patch, may be provided an antenna which covers combined bands of 700 MHz/800 MHz/1900 MHz, 700 MHz/900 MHz/1800 MHz, etc.

Referring to FIGS. 7 and 8, the ground pads 233 and 234 connected to ground of a circuit board are formed at both ends of a lower surface of a first dielectric layer 229. The feed pad 235 for feeding the first radiation patch 228 and the third radiation patch 224 is formed at an intermediate part of the dielectric chip 231. The ground pads 233 and 234, and the feed pad 235 are formed to directly attach the patch type antenna related to this preferred embodiment to a circuit board by a surface mounting method, etc.

The first radiation patch 228 formed on an upper surface of the first dielectric layer 229 is basically designed to have a pattern for covering the aforementioned low band. Here, at least two or three resonance points of a low band may be implemented by combining the second radiation patch 226 and the first radiation patch 228 with each other. The first radiation patch 228 is connected to the feed pad 235 by a conductive pin 236 formed in an up-down direction.

The second radiation patch 226 is formed on an lower surface of a second dielectric layer 225, and the third radiation patch 224 is formed on a upper surface of the second dielectric layer 248. The third radiation patch 224 has a constant pattern to cover a high band, but the second radiation patch 226 serves to ground the third radiation patch 224 in this preferred embodiment. Accordingly, the second radiation patch 226 is formed around the conductive pin 236. Referring to FIGS. 7 and 8, the second radiation patch 226 is floated with respect to the ground pads 233 and 234.

The first radiation patch 228 and the second radiation patch 226 are insulated from each other by the air gap layer 227. The air gap layer 227 serves to tune a resonance point of the first radiation patch 228. With respect to the third radiation patch 224, all of the second radiation patch 226, the air gap layer 227, and the first radiation patch 228 may serve as tuning means. Accordingly, at least two or three resonance points may be implemented according to a resonance type. The antenna structure of this preferred embodiment is implemented with one feed structure of MIMO and diversity in a portable terminal. This may widen a bandwidth much more than the conventional ceramic patch type antenna. As the second radiation patch 226 is used as an independent ground, an isolation characteristic may be improved.

The air gap layer 227 may be formed of a porous resin (e.g., sponge, cushion sheet, etc.), and may be implemented as a double-sided tape. In this case, the air gap layer 227 may serve to maintain a gap between the first dielectric layer 229 and the second dielectric layer 225, and to obtain a supporting force.

The first dielectric layer 229 and the second dielectric layer 225 may be formed of material having different dielectric constants (∈), or material having the same dielectric constant. For instance, when the first dielectric layer 229 has a dielectric constant of 20, the second dielectric layer 225 may be implemented to have a dielectric constant of 60.

Figure 9:
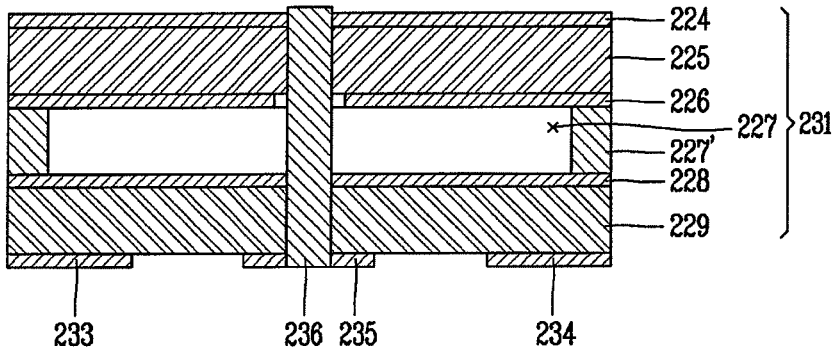
FIG. 9 is a sectional view showing another example of the hybrid antenna according to the present invention.

FIG. 9 is a sectional view showing another example of the hybrid antenna according to the present invention. The antenna includes an empty air gap layer 227, and two or more spacers 227' disposed at both ends of the air gap layer 227. The spacers 227' may be implemented by adhesive dielectric layers, or may be formed to have a structure to easily mount the first dielectric layer 229 and the second dielectric layer 225.

Figure 10:
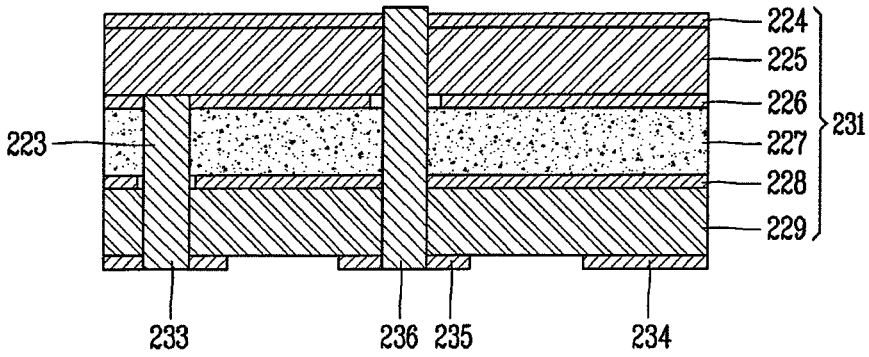
FIG. 10 is a sectional view showing still another example of the hybrid antenna according to the present invention.

FIG. 10 is a sectional view showing still another example of the hybrid antenna according to the present invention.

Referring to FIG. 10, the second radiation patch 226 is connected to the ground pad 235 by an additional conductive pin 223 which vertically penetrates the air gap layer 227 and the first dielectric layer 229. This may allow the second radiation patch 226 to be connected to ground of a circuit board. The second radiation patch 226 connected to the ground of the circuit board serves to extend the ground of the circuit board.

Figure 11:
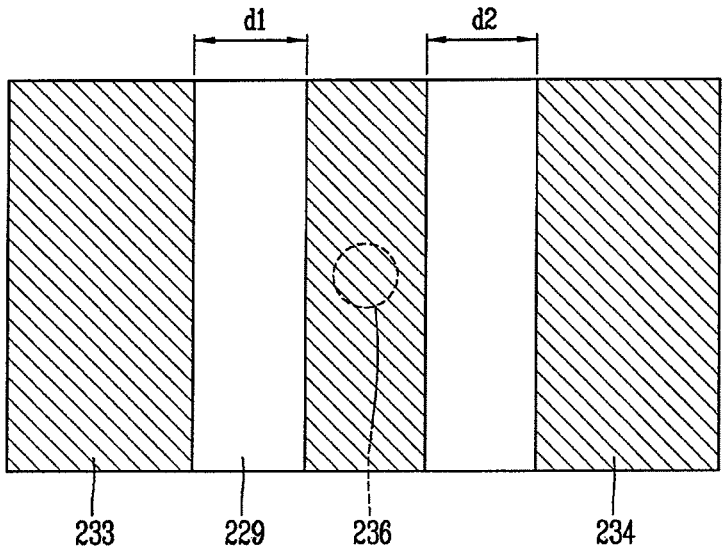
FIG. 11 is a bottom view of the hybrid antenna according to the present invention.

FIG. 11 is a bottom view of the hybrid antenna according to the present invention.

Referring to FIG. 11, the ground pads 233 and 234, and the feed pad 235 and the conductive pin 236 are arranged with adjustable distances d1 and d2 therebetween. By controlling these distances d1 and d2, wireless characteristics by the third radiation patch 224 and the first radiation patch 228 may be minutely controlled.

Figure 12:
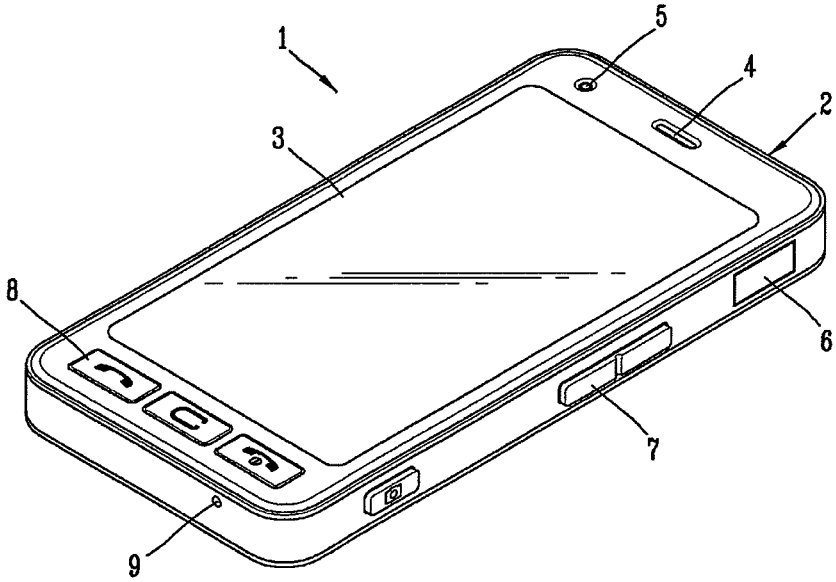
FIG. 12 is a perspective view showing one example of a portable terminal to which the hybrid antenna according to the present invention can be applied.
Figure 13:
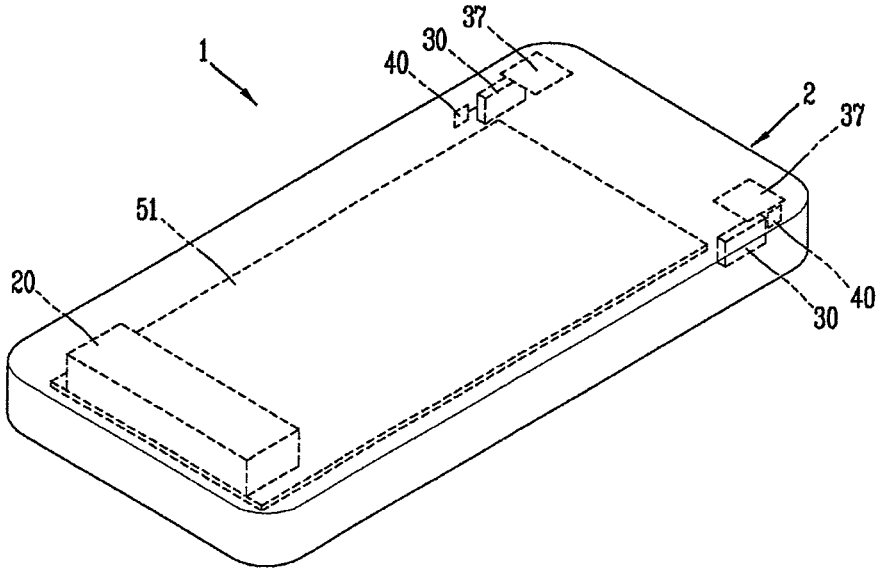
FIG. 13 is a conceptual view showing one example of the portable terminal to which the hybrid antenna according to the present invention can be applied.

FIG. 12 is a perspective view showing one example of a portable terminal to which the hybrid antenna according to the present invention can be applied, and FIG. 13 is a view schematically showing an antenna system mounted in the portable terminal of FIG. 12.

Referring to FIG. 12, the portable terminal 1 is provided with a bar type of terminal body 2. However, the portable terminal of the present invention is not limited to the bar-type of FIG. 12. That is, the portable terminal of the present invention may be applied to a folder type that two terminal bodies are connected to each other so as to be foldable, or a slide type that two terminal bodies are connected to each other so as to be slidable, or a portable terminal having a form factor.

A first user input unit 8, a display unit 3, an audio output unit 4, an image input unit 5, an audio input unit 9, etc. may be arranged on a front surface of the terminal body 2.

The first user input unit 8 receives commands for controlling the operation of the portable terminal according to the present invention.

The display unit 3 includes a liquid crystal display (LCD) module for visually displaying information, an organic light emitting diodes (OLED) module, e-paper, a transparent OLED (TOLED), etc. The display unit 3 includes a touch sensing means to receive information or control commands by a user's touch. The touch sensing means may include a transparent electrode film disposed in a window.

The audio output unit 4 may be implemented in the form of a receiver or a loud speaker, etc.

The image input unit 5 may be implemented as a camera module configured to capture a still image or a moving image of a user, etc.

The audio input 9 may be implemented as a microphone so as to receive a user's voice, other sound, etc.

The display 3 and the audio output unit 4 may be additionally installed on another surface of the terminal body 2 (e.g., side surfaces or a rear surface of the terminal body 2).

As shown in FIG. 12, a second user input unit 7, an interface unit 6, etc. may be disposed on side surfaces of the portable terminal 1.

The second user input unit 7 and the first user input unit 8 may be referred to as a manipulation portion, and may have any configuration to be manipulated in a user's tactile manner. For instance, the manipulation portion may be implemented as a dome switch, or a touch screen, or a touch pad which can receive information by a user's push or touch manner. Alternatively, the manipulation portion may be implemented as a jog wheel, a jog switch, and the like. In a functional aspect, the first user input unit 8 may be configured to input information such as numbers, characters and symbols, or menus such as 'START' and 'END' and 'SCROLL', whereas the second user input unit 7 may be operated as a hot key for performing a specific function such as activation of the image input unit 5 as well as a scroll function.

The interface unit 6 may serve as a passage through which the portable terminal 1 can perform data exchange, etc. with external devices. For instance, the interface unit 170 may include at least one of wired/wireless terminals to be connected to earphones, short-range communication ports (e.g., IrDA port, Bluetooth port, and wireless LAN port), and a power supply terminal for supplying power to the portable terminal. Also, the interface unit 6 may be implemented as a card socket (e.g., for coupling to a memory card, subscriber identity module (SIM) card, and user identity module (UIM) card).

As shown in FIG. 13, the terminal body 2 is mounted therein with the aforementioned main antenna 20, the first antenna 30, and the second antenna 40.

The main antenna 20 is resonated by being combined with a first ground 51 of the terminal body 2, whereas the first antenna 30 is resonated by being combined with a second ground 37 separately formed from the first ground 51. Here, the first ground 51 corresponds to a ground formed on a main circuit board, and the second ground 37 corresponds to the ground pads 233, 234, 333, 334, 433 and 434 or ground extension portions 337 and 437 extending from the ground pads 233,234,333,334,433 and 434.

More concretely, the first ground 51 and the second ground 37 are separated from each other. Accordingly, the first antenna 30 and the second antenna 40 are not influenced by radiation of the main antenna 20, and the main antenna 20 is less influenced by the first antenna 30*a* and the second antenna 40, either.

A first antenna 230 and a second antenna 240 are installed on two side surfaces of the circuit board, respectively, so as to have a constant distance from the main antenna 20. The first antenna 230 and the second antenna 240 may be referred to as 'diversity antenna' in that they implement spatial diversity of the main antenna 20. The antenna system of the present invention is not necessarily required to have a configuration of the first antenna 230 and the second antenna 240. That is, one of the first antenna 230 and the second antenna 240 may be omitted. The main antenna 20, the first antenna 230 and the second antenna 240 constitute an antenna system for implementing Multiple Input Multiple Out (MIMO), for instance. This antenna system may be suitable for a portable terminal required to process a large amount of wireless data such as LTE and HRPD.

For MIMO diversity, it is recommended to lengthen physical distances of the first antenna 230 and the second antenna 240 with respect to the main antenna 20. However, this is not easily implemented due to a narrow inner space of the portable terminal which has a small size. On the other hand, when the physical distances of the first antenna 230 or the second antenna 240 with respect to the main antenna 20 is shortened, a problem such as mutual coupling may occur.

In order to overcome this problem, the first antenna 230 and the second antenna 240 have second and third grounds 37 electrically shielded from the first ground 51 used by the main antenna 20. As the first antenna 230 and the second antenna 240, a chip antenna using a dielectric layer having a high dielectric constant may be used.

Figure 14:
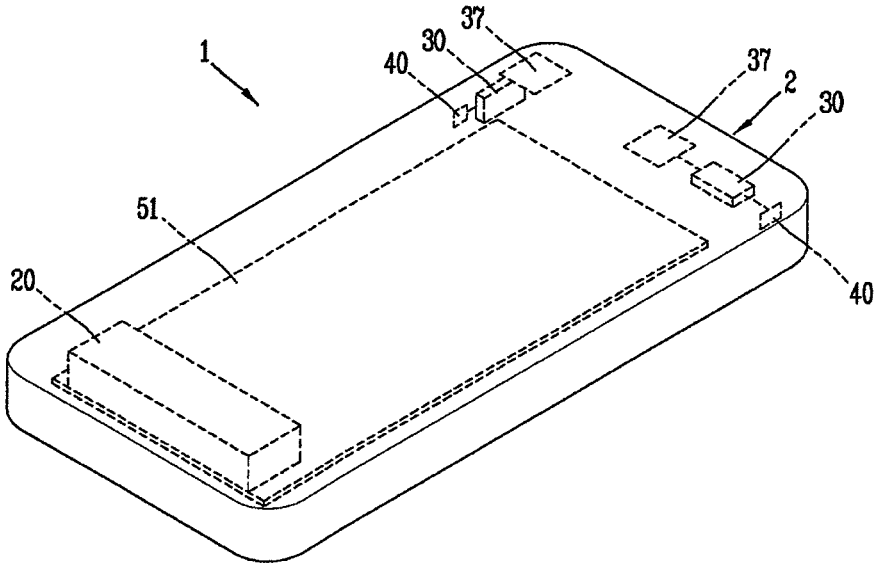
FIG. 14 is a conceptual view showing another example of the portable terminal to which the hybrid antenna according to the present invention can be applied.

As shown in FIG. 14, in the aspect of arrangement, the first antenna 230 and the second antenna 240 are arranged to have a predetermined angle with respect to the circuit board 50. Accordingly, radiation patterns of the first antenna 230 and the second antenna 240 have directivity different from a radiation pattern of the main antenna 20. This may allow the antennas to have an enhanced polarization characteristic. The first antenna 230 and the second antenna 240 are arranged to have about 90° with respect to the circuit board 50.

In the aspect of a structure, the first antenna 230 and the second antenna 240 may have the grounds 37 independent from the first ground, and may be supported by respective substrates (rigid PCBs or flexible PCBs).

By the arrangement of the antennas, an installation space of the antennas may be minimized, other components may be mounted. This may provide a portable terminal having an excellent antenna characteristic, and having enhanced spatial utilization.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A portable terminal comprising:

a terminal body; and a hybrid antenna mounted in the terminal body and having a plurality of antennas of different shapes, wherein the hybrid antenna includes:

a first antenna having one or more dielectric chips, a radiation patch formed on a first surface of the dielectric chip configured to operate at a first band, a feed pad formed on a second surface of the dielectric chip and the feed pad configured to feed the radiation patch, and one or more ground pads arranged on the second surface of the dielectric chip located at a predetermined distance from the feed pad;

a second antenna connected to the feed pad, and configured to operate at a second band higher than the first band; and a ground extension portion extending from one side of at least one ground pad of the one or more ground pads, and wherein the one or more ground pads are formed at both sides of the feed pad, and the ground extension portion extends from the one or more ground pads and implements one surface.

2. The portable terminal of claim 1, wherein the ground extension portion is bent by a predetermined angle with respect to the at least one ground pad of the one or more ground pads.

3. The portable terminal of claim 1, wherein one feed path feeds the first and the second antennas, and the first and the second antennas are connected to each other at the feed pad of the first antenna.

4. The portable terminal of claim 3, wherein the feed path is implemented as a coaxial cable or an FPCB.

5. The portable terminal of claim 1, wherein a distance between at least one ground pad of the one or more ground pads and the feed pad is adjustable.

6. The portable terminal of claim 1, wherein the dielectric chip includes:

a first dielectric layer having a first radiation patch on an upper surface of the first dielectric layer and a second radiation patch on a bottom surface of the first dielectric layer, wherein a bottom surface of the first dielectric layer forms at least a part of the second surface of the dielectric chip;

a second dielectric layer having a third radiation patch on an upper surface of the second dielectric layer, wherein the second dielectric layer is located below the first dielectric layer; and an air gap layer disposed between the first and second dielectric layers.

7. The portable terminal of claim 6, wherein the second radiation patch forms a ground for the first radiation patch.

8. The portable terminal of claim 6, wherein the second radiation patch is floated with respect to a ground of a circuit board.

9. The portable terminal of claim 6, wherein the second radiation patch is connected to the ground of the circuit board.

10. The portable terminal of claim 6, wherein the air gap layer is configured to maintain a constant gap by at least two spacers.

11. The portable terminal of claim 6, wherein the first radiation patch and the third radiation patch are connected to each other by a first conductive pin which penetrates the second radiation patch in a vertical direction, and are connected to the feed pad.

12. The portable terminal of claim 11, wherein the second radiation patch is connected to one of the one or more ground pads by a second conductive pin which vertically penetrates the air gap layer and the first dielectric layer.

13. The portable terminal of claim 6, wherein the first radiation patch has a pattern to radiate or receive wireless signals of a high band, whereas the third radiation patch has a pattern to radiate or receive wireless signals of low band.

14. The portable terminal of claim 1, wherein the second antenna is implemented as a flexible printed circuit board (FPCB).

15. The portable terminal of claim 1, further comprising:

a supporting body formed in respect to an internal shape of the portable terminal, and configured to support the first and second antennas.

16. A portable terminal comprising:

a main antenna disposed at a first position of a terminal body; and at least one hybrid antenna disposed at a second position of the terminal body at a predetermined distance from the first position, and configured to implement diverse band widths of the main antenna, wherein the at least one hybrid antenna includes:

a first antenna having one or more dielectric chips, a first radiation patch formed on a first surface of the dielectric chip configured to operate at a first band, a feed pad formed on a second surface of the dielectric chip and the feed pad configured to feed the first radiation patch, and one or more ground pads arranged on the second surface of the dielectric chip located at a predetermined distance from the feed pad, wherein the dielectric chip includes a first dielectric layer having the first radiation patch on an upper surface of the first dielectric layer and a second radiation patch on a bottom surface of the first dielectric layer, wherein a bottom surface of the first dielectric layer forms at least a part of the second surface of the dielectric chip, and a second dielectric layer having a third radiation patch on an upper surface of the second dielectric layer, and wherein the second dielectric layer is located below the first dielectric layer; and a second antenna connected to the feed pad, and configured to operate at a second band higher than the first band, the portable terminal further comprising:

a conductive pin configured to penetrate the second radiation patch in a vertical direction, the conductive pin connecting the first radiation patch and the third radiation patch, wherein the first radiation patch and the third radiation patch are connected to the feed pad.

17. The portable terminal of claim 16, further comprising a ground extension portion extending from one side of at least one ground pad of the one or more ground pads.

18. The portable terminal of claim 17, wherein the at least one ground pad and the ground extension portion are configured to be separated from ground of the main antenna.

19. The portable terminal of claim 17, wherein at least one ground pad of the one or more ground pads are formed at both sides of the feed pad, and the ground extension portion extends from the one or more ground pads and implement one surface.

20. The portable terminal of claim 17, wherein the ground extension portion is bent by a predetermined angle with respect to at least one ground pad of the one or more ground pads.

21. The portable terminal of claim 16, wherein the first and second antennas are arranged such that extended surfaces thereof are perpendicular to each other above the circuit board.

22. The portable terminal of claim 16, wherein the dielectric chip further includes an air gap layer disposed between the first and second dielectric layers.

23. The portable terminal of claim 16, wherein the first radiation patch has a pattern to radiate or receive wireless signals of a high band, whereas the third radiation patch has a pattern to radiate or receive wireless signals of a low band.

* * * * *